US005590875A

United States Patent [19]

Young

[11] Patent Number: 5,590,875

[45] Date of Patent: Jan. 7, 1997

[54] BASEBALL BAT

[76] Inventor: Gary Young, P.O. Box 1003, Westwego, La. 70094

[21] Appl. No.: 512,614

[22] Filed: Aug. 8, 1995

[51] Int. Cl.[6] ..... A63B 59/06

[52] U.S. Cl. ..... 473/457; 473/451; 473/571

[58] Field of Search ..... 273/26 B, 30; 473/234

[56] References Cited

U.S. PATENT DOCUMENTS

| | | | |
|---|---|---|---|
| 3,137,504 | 6/1964 | Zordan | 273/26 B |
| 3,215,437 | 11/1965 | Webb | 473/234 |
| 3,498,616 | 3/1970 | Hurst | 473/234 |
| 4,274,631 | 6/1981 | Hayazaki | 273/26 B |
| 4,635,935 | 1/1987 | Kane | 273/30 |
| 4,898,368 | 2/1990 | Anderson | 273/26 B |
| 4,953,868 | 9/1990 | Thompson | 473/234 |
| 4,969,921 | 11/1990 | Silvera | 473/234 |
| 5,082,283 | 1/1992 | Conley | 473/234 |
| 5,133,551 | 7/1992 | Handy | 273/26 B |

*Primary Examiner*—Theatrice Brown
*Attorney, Agent, or Firm*—Keaty & Keaty

[57] ABSTRACT

The invention relates to baseball equipment, and more particularly to a baseball bat and a baseball which are provided with an audible signal generating element. A hollow tube is positioned in the baseball bat and in the baseball, the hollow tube receiving a sliding element which moves between opposite ends of the tube as the baseball bat and baseball move through the air. A spring mounted in each of the opposite ends of the tube facilitates movement of the sliding element inside the tube as it bounces off the springs. When air is admitted into the hollow tube through a fittingly engaged plug, the audible signal is enhanced.

6 Claims, 2 Drawing Sheets

BASEBALL BAT

BACKGROUND OF THE INVENTION

This invention relates to baseball equipment, and more particularly to a baseball bat and ball which are designed for use by children during training or play.

Baseball continues to be one of the favorite pastimes of American children who devote many hours to training in this sport under the supervision of professional coaches or by themselves. In-as-much as baseball is a sport, as well as a game, various types of baseball equipment are available on the market. Some of the equipment is designed to be used in a strictly regulated professional field, while other equipment can be used in a non-professional environment, wherein thee weight and/or material of the baseball bat and the baseball do not have to comply with the rigid regulations.

The present invention contemplates provision of a baseball bat and a baseball which can be used by amateur baseball players for training or exercising while the equipment adds entertainment features to the traditional baseball game.

SUMMARY OF THE INVENTION

It is, therefore, an object of the present invention to provide a baseball bat and a baseball which can be used in lieu of the conventional baseball equipment.

It is another object of the present invention to provide a baseball bat and baseball which are provided with enhanced entertainment features.

It is a further object of the present invention to provide baseball equipment which would allow the players to practice their skills with the help of a changing audio signal.

These and other objects of the present invention are achieved through a provision of a baseball bat which comprises a handle portion and a striking portion fixedly attached to the handle portion. The striking portion is provided with means for generating an audible signal, for example a whistling sound, as the baseball bat moves through the air. The means for generating the whistling sound comprises a hollow tube which is fixedly secured inside the striking portion and extends substantially through the entire length thereof. A sliding element is mounted for movement between opposite ends of the hollow tube, while the hollow tube is provided with a resilient spring on each of the opposite ends thereof. As the whistling element moves through the hollow tube, it contacts one of the springs and bounces off of the spring to move in the opposite direction. An end plug with an opening is fitted into an end of the striking portion, the plug being provided with at least one opening to admit air into the hollow tube through the plug. As a result, a whistling sound is produced as the bat moves through the air.

A baseball, similarly to the baseball bat, is formed as a hollow body with a hollow tube mounted inside the body. Slidably frictionally movable within the hollow tube is a sliding element, or a whistle element, which moves between opposite ends of the tube and bounces off from the springs mounted in opposite ends of the tube. When air is admitted into the hollow tube, the sliding element produces an audible signal, for example a whistling sound, as the baseball is throwing into the air.

By learning to recognize the pitch of the sound produced by the sliding element within the hollow tube, a user can enhance his skills in the proper swing and strike.

BRIEF DESCRIPTION OF THE DRAWINGS

Reference will now be made to the drawings, wherein like parts are designated by like numerals, and wherein.

DETAILED DESCRIPTION OF THE PREFERRED EMBODIMENT

Figure 1:
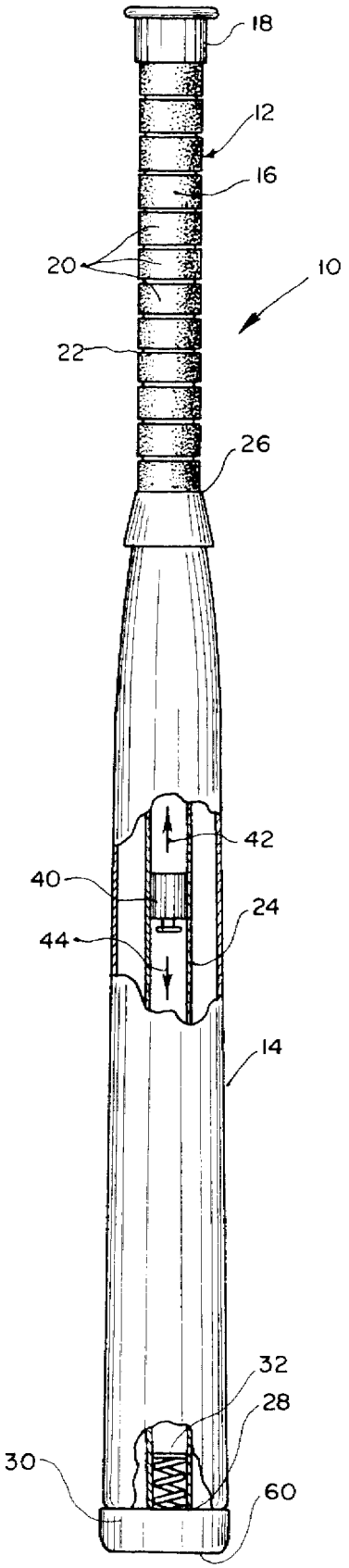
FIG. 1 is a perspective, partially cutaway view of a baseball bat in accordance with the present invention.

Reference will now be made to the drawings, wherein like parts are designated by like numerals, and wherein FIG. 1 illustrates a baseball bat 10 in accordance with the present invention. The bat 10 comprises a handle portion 12 and a striking portion 14. As can be seen in the drawing, the handle portion 12 is formed in a generally cylindrical form with the handle body 16 and a handle cap 18.

The handle body 16 is provided with a plurality of enlarged diameter gripping rings 20 which surround an inner cylindrical element 22. The rings 20 are formed from resilient, flexible material, preferably porous plastic to allow for increased friction between the hands of a player and the handle portion 12. The cap 18 closes the top of the handle 12 in a secure manner.

The striking portion 14 of the bat 10 is formed hollow, and an elongated tube 24 is positioned inside the striking portion 14, as shown in FIG. 1. The inner tube 24 extends substantially through the entire length of the striking portion 14 and is fixedly secured therein at the point of attachment of the striking portion 14 to the handle portion 12. This point is generally designated by numeral 26 in FIG. 1.

The opposite end of the tube 24 contacts an end plate 28 mounted between the striking portion 14 and an end cap 30. A resilient spring 32 is positioned inside the tube 24 adjacent the end plate 28, such that one end of the spring 32 urges against the plate 28. A similar spring (not shown) is positioned at the opposite end of the tube 24 adjacent to the point 26 where the handle 12 is attached to the striking portion 14.

A movable object which can be made in the shape of a cylinder, or a whistle 40, is positioned in a frictional slidable engagement within the tube 24 for movement between the spring 32 at one end of the striking portion 14 and a similar spring (not shown) mounted in the opposite end. The direction of movement of the whistle 40 is schematically shown by arrows 42 and 44. The weight of the element 40 is selected to cause a partial contraction of the spring 32 as it contacts the spring, so that the whistle 40 is "bounced off", to a degree, from the spring 32 to move in the direction of arrow 42. When the object 40 contacts the opposite spring (not shown) within the tube 24, the object 40 bounces off that spring and moves in the opposite direction shown by arrow 44. The diameter of the whistle 40 is slightly smaller than the inner diameter of the tube 24, such that the whistle 40 frictionally engages the inner wall 46 of the tube 24, thus preventing rattle of the whistle 40 inside the tube 24.

Figure 2:
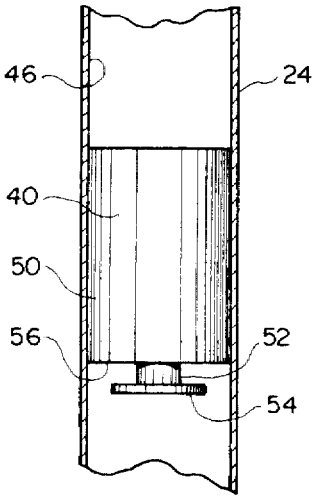
FIG. 2 is a detail view of an inner tube with a movable object positioned inside the tube.

If desired, the whistle 40 can be formed as a solid cylinder or in a shape shown in FIGS. 1 and 2, wherein the sliding object 40 is provided with a main body portion 50, a reduced diameter neck 52 and a transverse plate 54 which has a diameter greater than the neck 52 and smaller than the body 50. As a result, an annular shoulder 56 is formed on the main body 50, the shoulder 56 contacting the spring 32 when the whistle 40 moves in the tube 24 in the direction of arrow 44.

Figure 3:
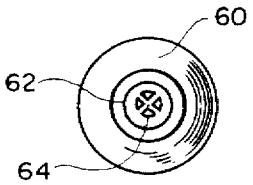
FIG. 3 is an end view of a striking portion of the bat shown in FIG. 1.

Turning now to FIG. 3, an end of the bat 10 is shown to comprise an annular plate 60 having a central opening which is sized and shaped to receive a plug 62 in a secure engagement. The plug 62 is provided with a plurality of openings 64 which allow air communication between the exterior of the striking portion 14 and the inner tube 24. As a result, when a user swings the bat 10, air is admitted into the inner tube 24 through the openings 64, causing the whistle 40 to move within the tube 24 and produce a sound of a certain frequency which depends on the speed with which the bat 10 moves through the air. By recognizing the pitch of the sound, the user can adapt to swing the bat 10 with the desired speed and direction.

Figure 4:
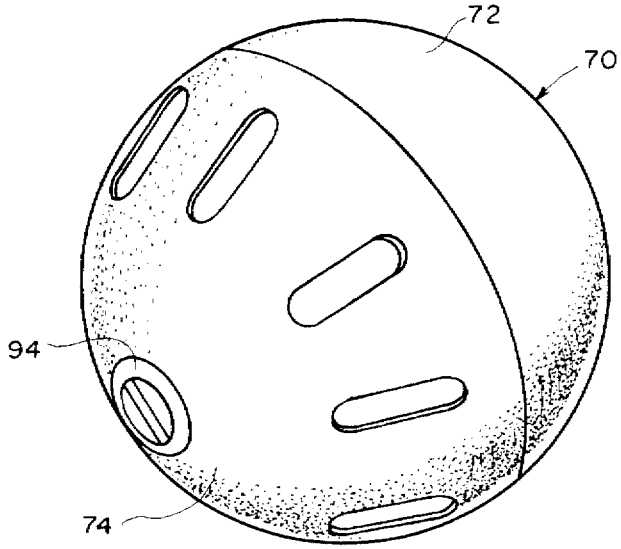
FIG. 4 is a perspective view of a baseball in accordance with the present invention.
Figure 5:
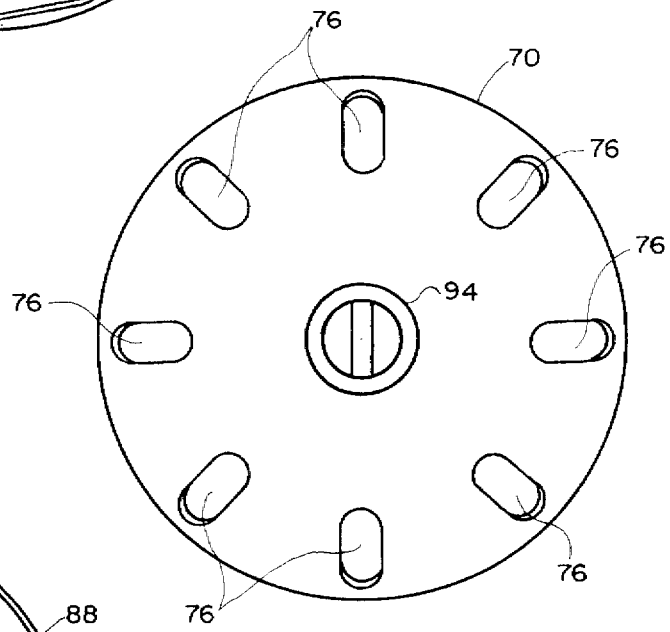
FIG. 5 is a side view showing one hemisphere of the ball illustrated in FIG. 4.
Figure 6:
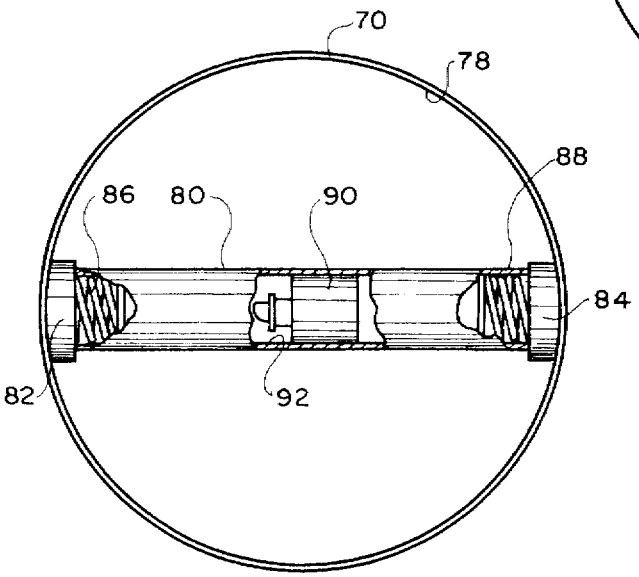
FIG. 6 is a cutaway view illustrating the inner tube positioned within the baseball.

Turning now to the baseball illustrated in FIGS. 4, 5 and 6, the baseball is generally designated by numeral 70 in the drawings. The baseball 70 is formed as a hollow sphere comprised of two fixedly engaged hemispherical parts 72 and 74. A plurality of elongated openings 76 are formed in an equidistantly spaced relationship in the hemisphere 74 to allow air to penetrate into the interior of the spherical body 70. A hollow cylindrical tube extends diametrically through the interior of the ball 70 and engages the inner wall 78, as can be better seen in FIG. 6. The tube 80 is provided with a pair of opposite caps 82 and 84 which contact the inner walls 78 and retain the tube 80 in a fixed engagement within the ball 70.

Mounted within the tube 80 are a pair of resilient springs 86 and 88 which urge against their corresponding caps 82 and 84, respectively. A cylindrical moveable whistle 90 moves in a sliding relationship within the tube 80, frictionally contacting an inner wall 92 of the tube 80 and alternatively contacting the springs 86 or 88 when the ball 70 rotates moving through the air. The whistle 90 "bounces off" between the springs 86 and 88 and produces a sound the frequency of which depends on the speed with which the ball is thrown. A plug 94 is fitted in the body of the hemisphere 74 to admit air into the inner tube 80 and, in combination with the object 90, to produce the desired sound.

Similarly to the bat 10, the ball 70 will allow the user to adjust the speed and rotation of the ball 70 to reach a desired speed and trajectory. The audible enhancement produced by the ball 70 and the bat 10 will facilitate training by providing additional means of determining the speed and path of movement of this baseball equipment.

The bat 10 and the ball 70 can be made from high impact resistant material, such as sturdy plastic, or other similar material to allow for inexpensive manufacture of the articles. At the same time, it is envisioned that a conventional wooden bat can be retrofitted by drilling an opening through the bat and inserting the inner tube to provide for the audible feature in accordance with the present invention. Similarly, a traditional baseball can be modified, while retaining the regulation weight and size.

Many changes and modifications can be made in the design of the present invention without departing from the spirit thereof. I, therefore, pray that my rights to the present invention be limited only by the scope of the appended claims.

I claim:

1. A baseball bat device, comprising:

a handle portion; and a striking portion fixedly attached to said handle portion, said striking portion being provided with means for generating an audible signal as the baseball bat moves through the air, said means for generating the audible signal comprising a hollow tube positioned inside the striking portion, a movable element which slides within said hollow tube and means for allowing fluid communication between an interior of the hollow tube and exterior of the striking portion, and wherein a resilient spring is mounted in each of the opposite ends of the hollow tube, so that the movable element is urged to move in an opposite direction after it has contacted one of the springs.

2. The device of claim 1, wherein said means for allowing fluid communication comprises an end plug fitted into an end of said striking portion, said end plug being provided with at least one opening through which air is admitted into the hollow tube.

3. The device of claim 1, wherein said hollow tube has a cylindrical inner wall and said moveable element has an exterior diameter slightly smaller than a diameter of said inner wall, so that the moveable element frictionally contacts said inner wall while slidably moving within said hollow tube.

4. A baseball bat device, comprising:

a handle portion; and a striking portion fixedly attached to said handle portion, said striking portion being provided with means for generating an audible signal as the baseball bat moves through the air, said means for generating said audible signal comprising a hollow tube positioned inside the striking portion, a moveable whistle element which slides within the hollow tube, and means for allowing fluid communication between an interior of the hollow tube and exterior of the striking portion, and wherein a resilient spring is mounted in each of the opposite ends of the hollow tube, so that the whistle element is forced to move in an opposite direction after it has contacted one of the springs.

5. The device of claim 4, wherein said means for allowing fluid communication comprises an end plug fitted into an end of said striking portion, said end plug being provided with at least one opening through which air is admitted into the hollow tube.

6. The device of claim 4, wherein said hollow tube has a cylindrical inner wall and said whistle element has an exterior diameter slightly smaller than a diameter of the inner wall, so that the moveable element frictionally contacts said inner wall while slidably moving within said hollow tube.

* * * * *